US005199704A

United States Patent [19]

Badami

[11] Patent Number: 5,199,704

[45] Date of Patent: Apr. 6, 1993

[54] POOL BALL POSITIONING APPARATUS

[76] Inventor: Raymond F. Badami, 4522 N. 40th St., Omaha, Nebr. 68111

[21] Appl. No.: 790,418

[22] Filed: Nov. 7, 1991

[51] Int. Cl.[5] ..... A63D 15/00

[52] U.S. Cl. ..... 273/2; 273/120 R; 273/129 Q

[58] Field of Search ..... 273/14, 2, 129 Q, 120, 273/86 C, 120 R

[56] References Cited

U.S. PATENT DOCUMENTS

| | | | |
|---|---|---|---|
| 735,132 | 8/1903 | McCutchen, Jr. | 273/2 |
| 1,681,590 | 8/1928 | Marczinko | 273/129 Q |
| 2,000,123 | 5/1935 | Cahill | 273/2 |
| 2,503,393 | 4/1950 | Lamprecht | 273/129 Q |

FOREIGN PATENT DOCUMENTS

| | | | |
|---|---|---|---|
| 119781 | 6/1930 | Fed. Rep. of Germany | 273/129 Q |
| 279929 | 12/1951 | Switzerland | 273/120 |
| 2750 | of 1905 | United Kingdom | 273/120 |
| 181881 | of 1922 | United Kingdom | 273/120 |

*Primary Examiner*—Theatrice Brown
*Attorney, Agent, or Firm*—Zarley, McKee, Thomte Voorhees & Sease

[57] ABSTRACT

A pool ball positioning apparatus includes a wedge-shaped body with an inclined upper surface having a channel formed therein to guide a pool ball along the length of the inclined surface. Preferably, the channel has an arcuate cross-section which matches the curvature of the pool ball, and the surface is sloped at an angle of approximately 21°. In use, the apparatus is positioned on a pool table and a pool ball is positioned in the channel at a predetermined position on the inclined surface. When the ball is released, it will roll across the pool table to the desired location.

2 Claims, 2 Drawing Sheets

POOL BALL POSITIONING APPARATUS

TECHNICAL FIELD

The present invention relates generally to the game of pool, and more particularly to an improved device for repetitively positioning a pool ball at a predetermined location on a pool table.

BACKGROUND OF THE INVENTION

Pool and billiards, as well as related games, require much practice in order to develop the skill necessary for professional play. In particular, some of the more difficult shots in pool games are preferably practiced over and over until the shot can be made with a high degree of confidence.

Such practice requires the set up of the shot by placing one ball on the pool table at a predetermined location, with the cue ball at a second predetermined location. In practicing difficult shots, it is important to maintain concentration so as to determine the cause of errors and the like. It can be difficult to maintain the proper concentration if it is necessary to reposition a ball on the pool table repeatedly after missing a particular shot. It also requires greater amounts of practice time to repeatedly walk around the table to position pool balls in the appropriate locations. It is therefore a general object of the present invention to provide an apparatus for positioning a pool ball at a predetermined location on a pool table.

Another object of the present invention is to provide a pool ball positioning apparatus which will repeatedly position a pool ball in an identical location without requiring the player to move around the pool table.

Yet another object is to provide a pool ball positioning apparatus which is simple to use, economical to manufacture, and refined in appearance.

These and other objects will be apparent to those skilled in the art.

SUMMARY OF THE INVENTION

The pool ball positioning apparatus of the present invention includes a wedge-shaped body with an inclined upper surface having a channel formed therein to guide a pool ball along the length of the inclined surface. Preferably, the channel has an arcuate cross-section which matches the curvature of the pool ball, and the surface is sloped at an angle of approximately 21°. In use, the apparatus is positioned on a pool table and a pool ball is positioned in the channel at a predetermined position on the inclined surface. When the ball is released, it will roll across the pool table to the desired location. After a shot is taken, a second pool ball can be positioned in the identical location on the pool table for additional practice by positioning the pool ball on the apparatus at the same location in the channel and permitting the ball to roll down the apparatus and on to the pool table.

DESCRIPTION OF THE PREFERRED EMBODIMENT

Figure 1:
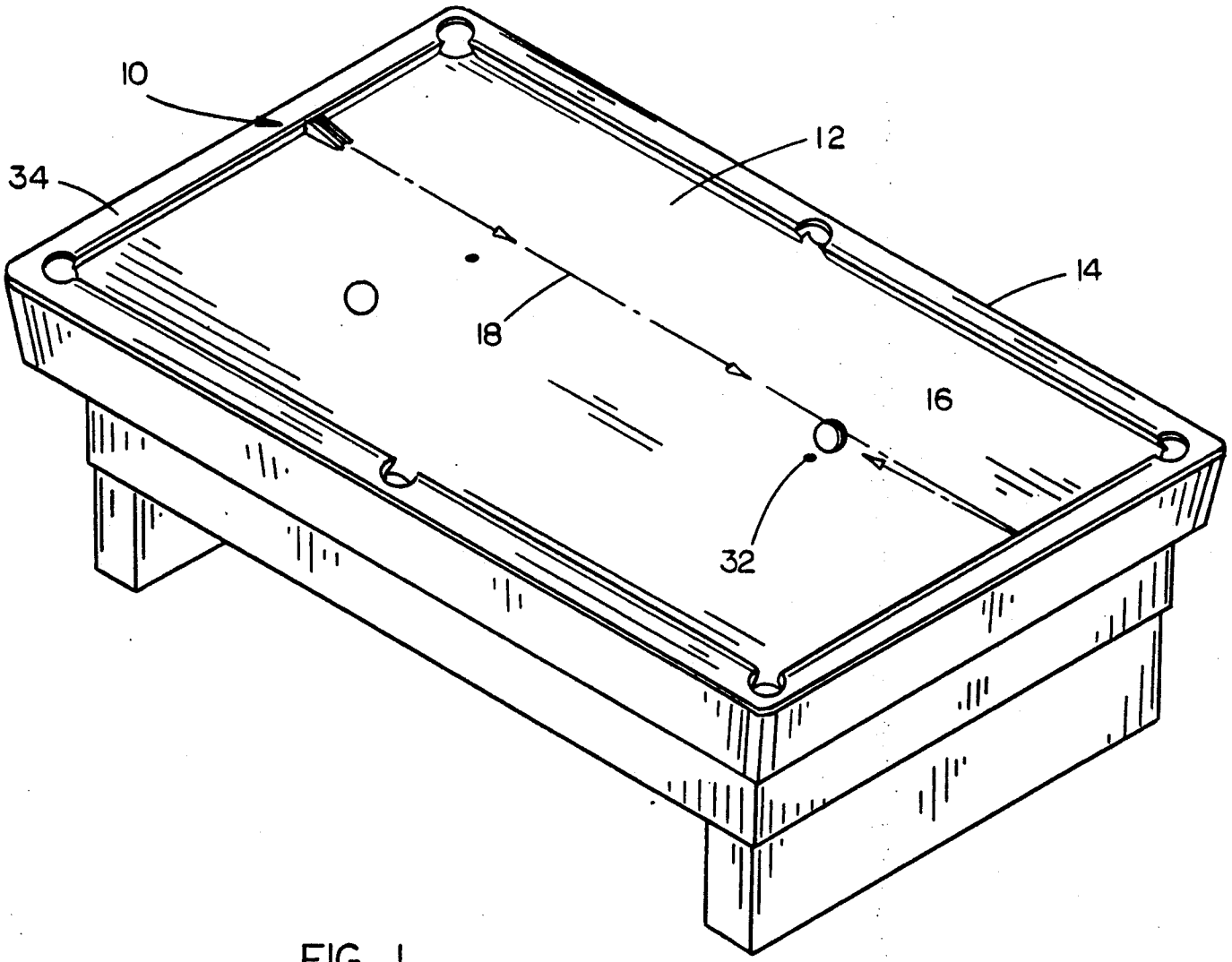
FIG. 1 is a pictorial view of the invention as utilized on a pool table.

Referring now to the drawings, in which similar or corresponding parts are identified with the same reference numeral, and more particularly to FIG. 1, the pool ball positioning apparatus of the present invention is identified generally at 10 and is shown located on the plane surface 12 of a pool table 14, with a pool ball 16 positioned on the pool table by use of the apparatus. Arrows 18 indicate the movement of the ball from the pool ball positioner 10 to the desired location on the pool table plane surface 12.

Referring now to FIGS. 2–5, ball positioning apparatus 10 includes a wedge-shaped body 20 having an inclined upper surface 22 a horizontal bottom surface 24, a vertical rearward surface 26 and opposing parallel triangularly shaped side surfaces 28 and 30. Preferably, bottom surface 24 has a length of about 4¾ inches, rearward surface 26 has a height of about 1¾ inches, and upper surface 22 has a length of approximately 5⅛ inches. These dimensions provide a very specific angle of inclination and length for upper surface 22 which will position a ball on the "dot" 32 marked on the plane surface 12 of a pool table when ball positioner 10 is placed against one end rail 34 of the pool table 14. Preferably, the angle of inclination is about 21° from the horizontal.

A channel 36 is formed along the length of upper surface 22 and is located midway between sides 28 and 30. Channel 36 is approximately ⅛ inch in depth and serves to guide a pool ball 38 down upper surface 22. Preferably, channel 36 has an arcuate cross-section which matches the curvature of a pool ball. A width of about ¾ inch is utilized for channel 36, to guide the ball.

A plurality of felt pads 40 are mounted on bottom surface 24 of body 20 to frictionally engage the plane surface 12 of pool table 14. Pads 40 thereby prevent accidental movement of the ball positioning apparatus 10 on the pool table.

Figure 2:
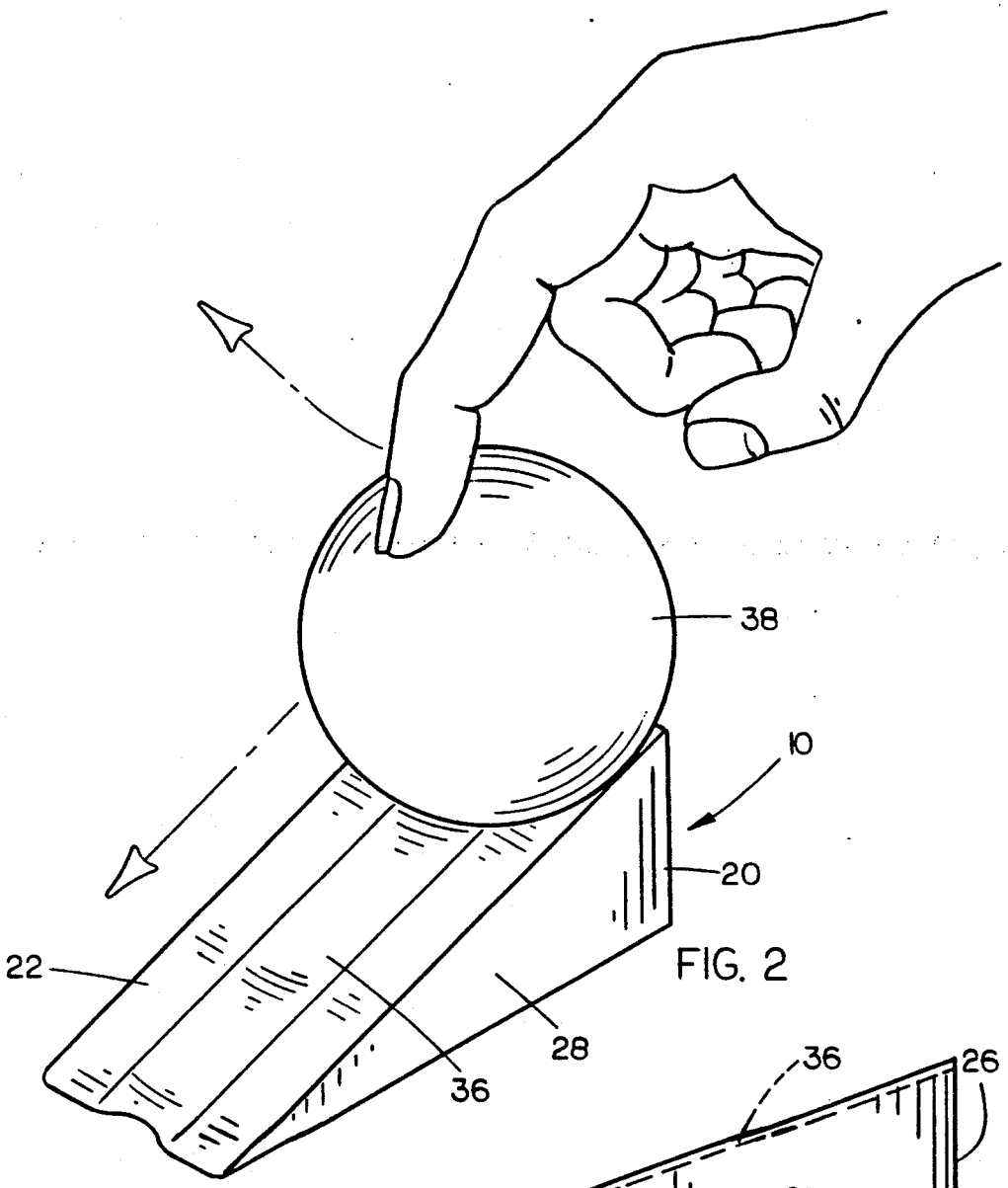
FIG. 2 is an enlarged pictorial view of the invention showing the method of use.
Figure 4:
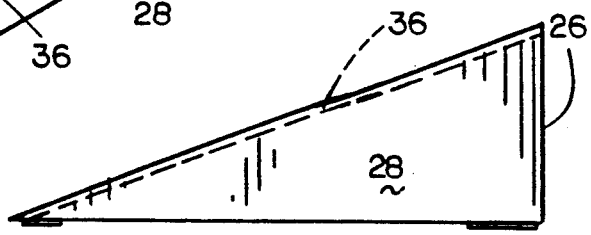
FIG. 4 is a side elevational view of the invention.
Figure 3:
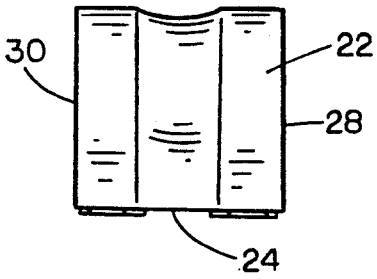
FIG. 3 is a front elevational view of the invention.
Figure 5:
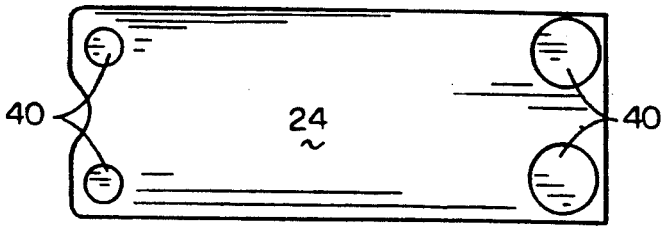
FIG. 5 is bottom view of the invention.

In use, a ball 38 is positioned on upper surface 22 of body 20, as shown in FIG. 2. Obviously, the closer ball 38 is positioned to rearward surface 26, the farther ball 38 will roll when released. The cue ball may then be positioned on the plane surface where desired to set up the desired shot. Using ball positioning apparatus 10 permits the player to precisely position the pool ball 38 in the same position every time, to permit repetitive practice of desired shots.

Whereas the invention has been shown and described in connection with the preferred embodiment thereof, it will be understood that many modifications, substitutions and additions may be made which are within the intended broad scope of the appended claims. There has therefore been shown and described an improved pool ball positioning apparatus which accomplishes at least all of the above stated objects.

I claim:

1. A method for repetitively positioning a pool ball at substantially the same location on a pool table, comprising the steps of:

providing a standard size pool table with a felt playing surface and standard pool balls;

providing a pool ball positioning apparatus having a wedge-shaped body with an inclined upper surface sloped downwardly and forwardly from a rearward surface to a forward end, a bottom surface and a straight channel formed in said upper surface extending from the rearward surface along the entire length of said upper surface, the channel having an arcuate shape in transverse cross-section matching the curvature of said pool balls, and the upper surface being inclined at an angle of approximately 21° from the horizontal;

locating the ball positioning apparatus on the felt playing surface of said pool table with the bottom surface resting on the playing surface of the pool table;

positioning one of said pool balls at a predetermined location in the channel on the upper surface;

releasing the ball to permit the ball to roll down the inclined surface to a first position on the playing surface of the pool table;

displacing said ball at said first position with another pool ball which has been moved by a pool cue;

positioning a second pool ball on the wedge-shaped body at.said predetermined location; and, releasing said second pool ball to locate said second pool ball at substantially said first position.

2. The method of claim 1, further comprising the steps of:

displacing the positioned second pool ball with another pool ball; and repeating the steps of positioning, releasing and displacing, so as to repetitively position pool balls at substantially the same location on the pool table playing surface as a previously positioned ball.

* * * * *